US009890019B2

(12) United States Patent
Kere et al.

(10) Patent No.: US 9,890,019 B2
(45) Date of Patent: Feb. 13, 2018

(54) ARRANGEMENT AND A METHOD FOR PARALLEL TRANSPORT AND INSTALLATION OF ELEVATOR COMPONENTS

(71) Applicants: Petri Kere, Helsinki (FI); Antti Mertala, Hyvinkaa (FI)

(72) Inventors: Petri Kere, Helsinki (FI); Antti Mertala, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 15/140,667

(22) Filed: Apr. 28, 2016

(65) Prior Publication Data

US 2016/0332845 A1 Nov. 17, 2016

(30) Foreign Application Priority Data

May 12, 2015 (EP) ..... 15167328

(51) Int. Cl.

| | |
|---|---|
| ***B66B 19/00*** | (2006.01) |
| ***E04G 3/28*** | (2006.01) |
| ***E04G 3/24*** | (2006.01) |

(52) U.S. Cl.

CPC ..... *B66B 19/002* (2013.01); *B66B 19/00* (2013.01); *E04G 3/246* (2013.01); *E04G 3/28* (2013.01); *E04G 2003/286* (2013.01)

(58) Field of Classification Search

CPC ... B66B 19/002; B66B 9/00; E04G 2003/286; E04G 3/28; E04G 3/246

See application file for complete search history.

(56) References Cited

U.S. PATENT DOCUMENTS 3,851,736 A * 12/1974 Westlake ..... B66B 19/002 29/429
5,230,404 A * 7/1993 Klein ..... B66B 19/00 187/414

(Continued)

FOREIGN PATENT DOCUMENTS

| | | |
|---|---|---|
| EP | 2746210 A1 | 6/2014 |
| JP | S63123785 A | 5/1988 |
| JP | 2015000798 A | 1/2015 |

OTHER PUBLICATIONS

European Search Report for European Application No. EP 15167328.2 dated Nov. 3, 2015.

*Primary Examiner* — Andrew J Triggs
(74) *Attorney, Agent, or Firm* — Harness, Dickey & Pierce, P.L.C.

(57) ABSTRACT

A material transport and installation arrangement comprising a first working platform system in an elevator shaft for reaching a first installation height; and a first material hoisting system for moving elevator components vertically in the elevator shaft is disclosed. The arrangement is characterized in that it comprises a second working platform system in the elevator shaft for reaching a second installation height, the second working platform system comprising a second platform hoist, second platform roping and a vertically moveable second working platform, the second working platform being below the first working platform; and a second material hoisting system for moving elevator components vertically in the elevator shaft, the second material hoisting system comprising a second material hoist, second material roping and a second material holder. Further, a method for parallel transport and installation of elevator components is disclosed.

14 Claims, 3 Drawing Sheets

(56) References Cited

U.S. PATENT DOCUMENTS

| | | | | |
|---|---|---|---|---|
| 7,467,691 | B2 * | 12/2008 | Deplazes | B66B 37/021 187/249 |
| 7,635,049 | B2 * | 12/2009 | Van Der Meijden | B66B 19/002 187/401 |
| 9,169,107 | B2 * | 10/2015 | Wilts | B66B 19/002 |
| 2015/0107186 | A1 | 4/2015 | Wilts et al. | |
| 2016/0251863 | A1 * | 9/2016 | Cao | B66C 13/04 |
| 2016/0332845 | A1 * | 11/2016 | Kere | B66B 19/00 |

* cited by examiner

ARRANGEMENT AND A METHOD FOR PARALLEL TRANSPORT AND INSTALLATION OF ELEVATOR COMPONENTS

This application claims priority to European Patent Application No. 15167328.2 filed on May 12, 2015, the entire contents of which are incorporated herein by reference.

TECHNICAL FIELD

The present disclosure relates to an arrangement and a method for transporting and installing elevator components.

BACKGROUND ART

During the construction of a building, elevator shafts are often used for transporting construction material from the bottom floor to higher floors. Elevator components and also items necessary elsewhere in the construction site can be transported in the elevator shaft. Especially guide rail sections and components needed in the finalizing landing entrances are transported in the elevator shaft.

An elevator is typically installed in a number of consecutive steps. First, elevator car guide rails and counterweight guide rails are installed by transporting one guide rail section at a time to an installation height using a vertically moveable working platform. The next guide rail section can only be retrieved after the installation of the previous one is complete and the working platform is available. Only after the guide rails are installed, other components, needed either in the elevator shaft or in the landing entrances, are transported—again one-by-one—and installed.

Further, the size and carrying capacity of the working platform sets an upper limit for the size and weight of the material to be transported. Therefore, first, it is not possible to pre-assemble the landing entrance components into pre-assembled landing door arrangements. Second, only a limited number of guide rail sections can be transported during the installation of the elevator car guide rails and counterweight guide rails.

Drawbacks of the current solutions are that transporting material in the elevator shaft is dependent on the working platform. Therefore, while it is used for stationary installation work, material cannot be transported vertically in the elevator shaft. Further, bulky material needs to be transported in smaller batches than would be optimal for the speed of installation.

Especially, the drawback of the current methods of elevator installation is that the landing entrance equipment cannot be pre-assembled and transported in the elevator shaft as a pre-assembled landing door arrangement.

The inventors have thus recognized the need for an arrangement and a method allowing the parallel transport and installation of both guide rails and landing entrance components.

SUMMARY

An object of the present invention is to alleviate at least one of the problems related to prior art. Especially, it is the object of the present invention to provide a new arrangement and a method for transporting and installing elevator components that allows the parallel execution of more than one installation and/or transportation step.

The transport and installation arrangement and the method according to the present disclosure are in particular, but not only, intended for elevators, especially for passenger or cargo elevators of buildings.

The transport and installation arrangement according to the present disclosure is characterized by what is presented in claim 1.

The method according to the present disclosure is characterized by what is presented in claim 15.

The use according to the present disclosure is characterized by what is presented in claim 19.

The transport and installation arrangement according to the present disclosure and the method for transporting and installing elevator components can offer at least one of the following advantages over prior art:

The transport and installation of different elevator components can be done independently of the installation of other components. Especially, guide rails and landing entrance components can be transported and installed in parallel.

The landing entrance components can be transported by a hoisting system that is dedicated for them and can thus be optimized for carrying bulky assemblies, such as pre-assembled landing door arrangements.

Also guide rail sections can be transported with a dedicated hoisting system. Thus more than one guide rail section can be transported simultaneously. Therefore, guide rail installation is faster, since more than one guide rail section can be installed in sequence without having to retrieve a new guide rail section after installing the previous one. The distance a guide rail section needs to be moved individually is kept short.

The elevator installation can be completed faster and the idle time for both tools and personnel is reduced.

As each working platform system and material hoisting system is operated independently of the other systems, the installation work on each working platform can continue while the hoisting systems are in use, further improving the efficiency of installation. This advantage can be effected while elevator components are moved either down- or upwards. If the bottom of the elevator shaft is appropriately protected, the installation work can continue also during the time new guide rail sections are loaded on the transport frame.

BRIEF DESCRIPTION OF DRAWINGS

The accompanying drawings, which are included to provide a further understanding of the disclosure and constitute a part of this specification, illustrate embodiments and together with the description help to explain the principles of the current disclosure but the disclosure is not limited to the specific embodiments illustrated in the drawings. In the drawings.

DETAILED DESCRIPTION

Figure 1:
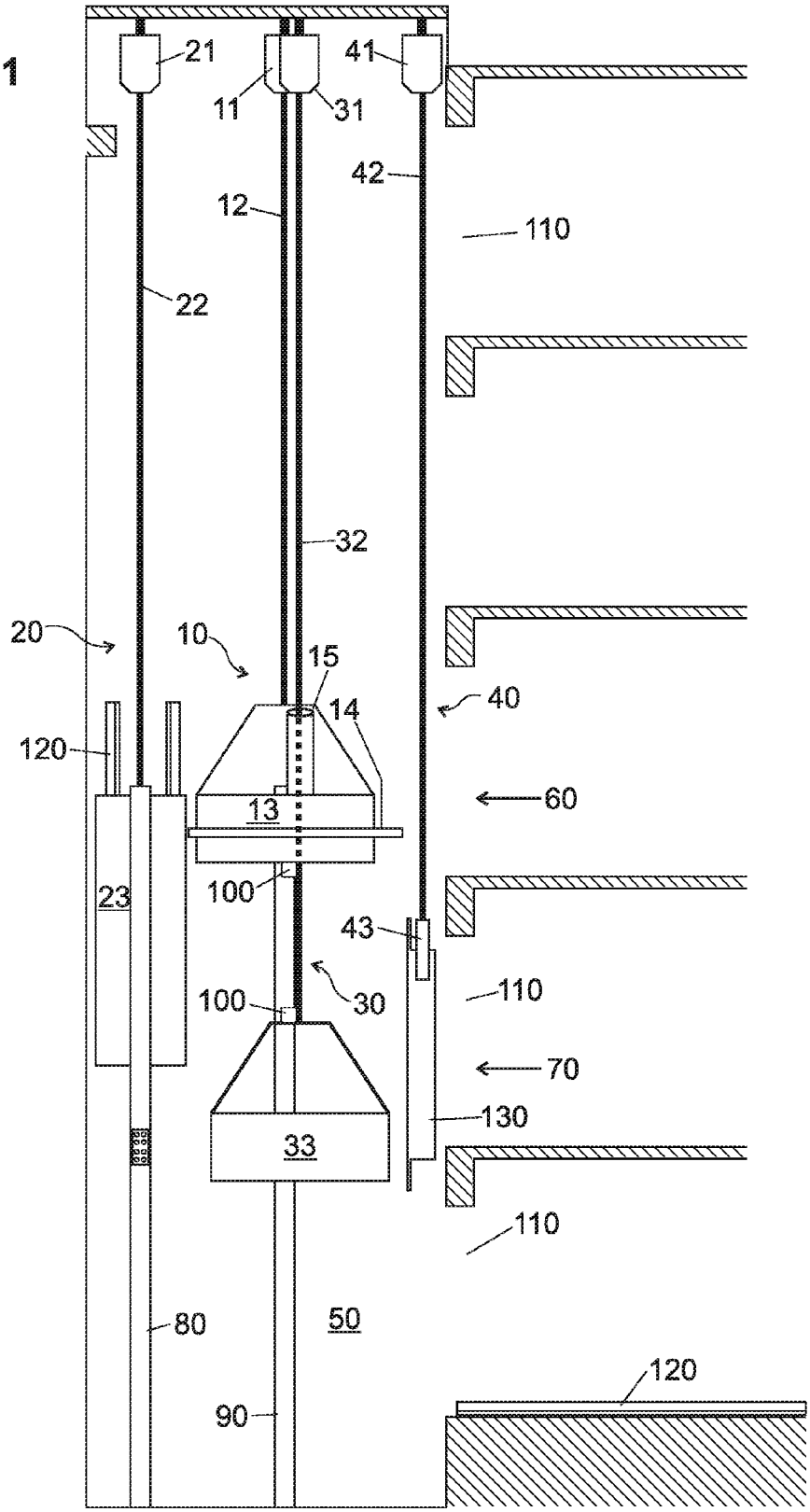
FIG. 1 presents an embodiment of the material transport and installation arrangement according to the present disclosure.

In one aspect, a transport and installation arrangement for parallel transport and installation of elevator components is disclosed.

The transport and installation arrangement is a temporary assembly which is meant to speed up elevator installation procedure and to reduce idle time during the process. Any elevator installation site can benefit from the arrangement according to the present disclosure.

The current arrangement can be especially well suited for elevators in high-rise buildings, in which the installation height and/or the hoisting distance can be hundreds of meters. In such buildings, shuttle elevators can be used and the distance between two landings can be more than one floor of the building. It is possible that the distance between two landings is hundreds of meters. For example, if the installation height and/or the hoisting distance of the elevator are/is at least 50 meters, the current transport and installation arrangement may be advantageous. An installation height and/or hoisting distance of at least 100 meters, 150 meters or 250 meters is also possible. Even longer distances are likely to become more common, and the current transport and installation arrangement can be suited for such construction sites. The installation height increases with each added guide rail section that increases the height of the guide rail.

The arrangement and the method according to the present disclosure are meant primarily for transporting and installing elevator components. By elevator components is herein meant all components belonging to the construction of a functional elevator. The elevator components include, but are not limited to, elevator car guide rails, counterweight guide rails, landing doors, landing door frames, elevator safety equipment, electrical components, elevator car, counterweight and elevator shaft lights. In addition to elevator components, also other material used in the construction site can be transported. The arrangement and the method according to the present disclosure can be used for installing a new elevator or for modernizing an existing elevator.

The arrangement and method according to the present disclosure are meant for enabling the parallel transport and/or installation of elevator components. The arrangement can be used especially for transport and installation in the elevator shaft. The arrangement can be used especially for transport of elevator components. However, also the transport of other material, not necessarily relating to elevator installation, can be transported by the current arrangement. This can contribute to the efficient progress of the construction project as a whole, since for some material, the elevator shaft might be the most convenient transport route.

By parallel installation and transport is herein meant the possibility for performing different construction steps at the same time. In other words, in parallel installation and transport, at least some transport and installation steps can be performed independently of other transport and installation steps. This allows them to be conducted at the same time. For example, the guide rails can be installed at the same time with the installation of landing entrance components.

By a guide rail herein is meant a continuous rail that guides the substantially vertical movement of an elevator car or a counterweight in an elevator shaft. The guide rail for the counterweight is termed a counterweight guide rail. The guide rail for the elevator car is termed an elevator car guide rail. Typically, guide rails are used as pairs, so that there is one guide rail on two opposite sides of the counterweight and the elevator car. However, especially the counterweight can only have one guide rail.

By a guide rail section is herein meant a section of a guide rail that is attachable or attached from its one end to an adjacent guide rail section or from its both ends to two adjacent guide rail sections. Guide rail sections are usually several meters in length, a length of 5 m being typical. Guide rail sections are usually made of steel, although other materials might be suitable. The material and exact dimensions depend on the specific application for which the guide rail sections are used.

By installing guide rails is herein meant the procedure according to the methods known in the art for constructing a functional guide rail. Typically, during the installation, the guide rail sections are fixed to the wall of the elevator shaft or other stable structures, attached to the adjacent guide rail section and the straightness of the guide rail is checked. The details of the procedure vary as is known to the skilled person.

By a landing is herein meant a location at which the elevator car can load or unload passengers or cargo. The hoisting distance of the elevator, i.e. the vertical distance between the lowest landing and the highest landing, is independent of the number of landings.

By a landing entrance is herein meant the opening in the elevator shaft wall, through which cargo and/or passengers are moved between the elevator car and the landing. The landing entrance comprises specialized equipment, such as doors, door frames and catching means for synchronizing the opening and closing of landing entrance doors and elevator car doors. By landing entrance components is herein meant all the equipment needed for constructing a functional landing entrance.

The transport and installation arrangement according to the present disclosure is constructed usually in the beginning of the elevator installation procedure and disassembled when the installation is finished. In some situations, the arrangement can be used only during a part of the elevator installation and other installation systems can be used complementarily. It is possible to construct the transport and installation arrangement according to the present disclosure only partially and also to disassemble it only partially. The components of the transport and installation arrangement according to the present disclosure can be reusable in other elevator installation sites.

The current transport and installation arrangement comprises a first working platform system in an elevator shaft for reaching a first installation height, the first working platform system comprising a first platform hoist, first platform roping and a vertically moveable first working platform; and a first material hoisting system for moving elevator components vertically in the elevator shaft, the first material hoisting system comprising a first material hoist, first material roping and a first material holder, the first material holder being moveable along at least one counterweight guide rail.

The transport and installation arrangement is characterized in that it further comprises a second working platform system in the elevator shaft for reaching a second installation height, the second working platform system comprising a second platform hoist, second platform roping and a vertically moveable second working platform, the second working platform being below the first working platform;

a second material hoisting system for moving elevator components vertically in the elevator shaft, the second material hoisting system comprising a second material hoist, second material roping and a second material holder.

The transport and installation arrangement according to the present disclosure comprises four different vertically moving systems, namely the first working platform system, the first material hoisting system, the second working platform system and the second material hoisting system. All of them comprise a hoist and roping, which can have generally similar structure in all systems. The hoist and roping in each system can be adapted to the specific function of each system. For example, the loads and necessary moving speeds of different systems can be taken into account.

By a hoist is herein meant a device powering the vertical movement of the system in question, i.e. a traction hoist. Many such devices, for example wire rope climbers and winches, are known in the art. A commonly used one is a Tirak hoist. The hoist in each system can be mounted in the top part of the elevator shaft. A suitable mounting position is, for example the ceiling of the elevator shaft or a wall in the top part of the elevator shaft.

Alternatively, at least one of the hoists can be mounted on a lifting beam. By a lifting beam is herein meant a beam running essentially across the elevator shaft and to which hoists are secured. The lifting beam can be at any suitable height within the elevator shaft. The vertical position of a lifting beam can change during the construction of the elevator. Typically, the lifting beam is affixed to strong structures at the top of the elevator shaft. There can be two or more lifting beams. In some applications, more than one lifting beam can be used for one hoist. It is possible to suspend more than one hoist from one lifting beam. Many alternative solutions for installing a lifting beam in the elevator shaft are known in the art and any of them can be used for the guide rail installation arrangement according to the present disclosure.

The hoists can be mounted directly to the structure in question, i.e. the elevator shaft or the lifting beam, or additional roping or support structures can be used.

In one embodiment, the first working platform system and/or the second working platform system are mounted to the top part of the elevator shaft, or the first working platform system and/or the second working platform system are mounted to one or more lifting beams installed above the first and second installation heights. It is possible to mount the first working platform system and/or the second working platform system to the top part of the elevator shaft. Alternatively, the first working platform system and/or the second working platform system are mounted to one or more lifting beams installed above the first and second installation heights. If the two working platform systems are suspended from more than one lifting beams, the lifting beams are substantially at the same height. Alternatively, the more than one lifting beams can be at different heights. It is also possible to mount one of the working platform systems from one or more lifting beams and the other working platform system from the elevator shaft structures, such as the ceiling or wall.

An embodiment is possible, in which the first material hoisting system and/or the second material hoisting system are mounted to the top part of the elevator shaft, or the first material hoisting system and/or the second material hoisting system are mounted to one or more lifting beams installed above the first and second installation heights. It is possible to mount the first material hoisting system and/or the second material hoisting system to the top part of the elevator shaft. Alternatively, the first material hoisting system and/or the second material hoisting system are mounted to one or more lifting beams installed above the first and second installation heights. If the two material hoisting systems are suspended from more than one lifting beams, the lifting beams are substantially at the same height. Alternatively, the more than one lifting beams can be at different heights. It is also possible to mount one of the material hoisting systems from one or more lifting beams and the other material hoisting system from the elevator shaft structures, such as the ceiling or wall.

In some alternative embodiments, the hoist, in each system independently, can be mounted on the working platform or to the material holder. In such embodiments, the platform roping or the material roping can be attached to the top part of the elevator shaft, or to at least one lifting beam.

In some applications, the first material hoist is mounted above the vertical center-line between two counterweight guide rails. In such a system, the first material holder can be placed between the counterweight guide rails and lifted directly upwards by the first material hoist. In some applications, the first or second platform hoist is mounted above the vertical center-line between two elevator car guide rails. In such a system, the first or second working platform can be placed between the elevator car guide rails and lifted directly upwards by the first platform hoist.

All the four systems (i.e. the first working platform system, the first material hoisting system, the second working platform system and the second material hoisting system) further comprise roping, which can be a wire rope or a chain. The roping comprises attachment means, such as a hook or a grapple for holding the working platform or the material holder. The attachment means allows the working platform or the material holder to be removably attachable. This means that the working platform or the material holder attached to each roping can be attached and removed repeatedly. This is advantageous as in many applications, the four hoists and ropings might be identical and used as a part of any of the four systems. Further, the assembly and disassembly of the transport and installation arrangement is simplified when the working platforms and the material holders are separable from the hoists and ropings.

The roping can comprise a simple, vertically hanging metal wire, but especially for the second working platform and the second material holder, the roping can be more sophisticated, comprising multiple ropes or wires and sheaves to adjust the direction in which the roping moves.

The vertical movement of all the systems in the current transport and installation arrangement needs to be controlled. The systems can be manually driven from one or both of the working platforms or from another location inside or outside the elevator shaft. Alternatively, the arrangement can comprise automation means for facilitating its operation. For example automatic or semi-automatic control of the movement of one or more of the systems is possible.

The transport and installation arrangement further comprises safety devices for ascertaining the safety of the personnel using the arrangement and outsiders.

In one embodiment, the first working platform system is mounted to the top part of the elevator shaft, or the first working platform system is mounted to one or more lifting beams installed above the first and second installation heights; and the second working platform system is mounted on the first working platform. In this embodiment, the first working platform is mounted to the top part of the elevator shaft or to one or more lifting beams. The lifting beam can be installed at any position above the first and second installation heights. The second working platform is mounted on the first working platform. In other words, the second platform hoist is directly, or through intermediate parts, mounted on the structures of the first working platform. The second working platform system hangs from the first working platform. The two platforms can still be moved vertically independently of each other, as long as their collision is prevented by limit switches or other safety mechanisms.

To allow for the independent vertical movement of the two working platforms, the length of the second platform roping is adjusted at a speed that equals the speed at which the distance of the two platforms is changing. For example, the length of the second platform roping is decreased in situations where the first working platform is stationary and the second working platform moves upwards, or when the first working platform moves downwards and the second working platform is stationary or moves upwards. Conversely, the length of the second platform roping is increased in situations where the first working platform is stationary and the second working platform moves downwards; or when the first working platform moves upwards and the second working platform is stationary or moves downwards.

In situations where both working platforms move to the same direction (i.e. both upwards or both downwards), the decrease or increase in the second platform roping length depends on whether there is a speed difference between the working platforms. If both working platforms move upwards, and the first working platform moves faster than the second working platform, the length of the second platform roping is increased. If the first working platform moves slower than the second working platform, the length of the second platform roping is decreased. The situation is opposite when both working platforms move downwards.

If both working platforms move upwards, embodiments can be envisaged in which the second working platform is hoisted by the first working platform system. In other words, the length of the second working platform roping remains constant.

There are many alternatives for designing a driving system for the platforms in which the length of the second platform roping is adjusted to achieve the independent vertical movement of the working platforms. The vertical movement of the working platforms can be manually controlled. The vertical movement of the working platforms can be controlled semi-automatically. The vertical movement of the working platforms can be controlled automatically. The automated control may be effected by a computer.

By a working platform is herein meant a platform that is used for performing installation work in an elevator shaft during the installation or maintenance work of the elevator. Each working platform is suspended from its own platform hoist and platform roping. In some applications, the first working platform and/or the second working platform are moveable along elevator car guide rails. In one embodiment, the first working platform system and/or the second working platform system are moveable along elevator car guide rails. The working platforms comprise components known in the art, including safety equipment and optional drive controls.

If the first or the second working platform are moveable along counterweight guide rails, they typically comprise guiding means, such as rollers, wheels or guide shoes, for guiding their movement along the guide rails. In an embodiment, the first working platform comprises guiding means, such as rollers, wheels or guide shoes, for guiding the movement of the first working platform along the guide rails. In an embodiment, the second working platform comprises guiding means, such as rollers, wheels or guide shoes, for guiding the movement of the second working platform along the guide rails. Typically, the first and second working platform move between two guide rails, and the guiding means are situated on their both sides. There can be one or more guiding means on each side of the working platforms.

In one embodiment, the first working platform or the second working platform comprises an elevator car sling or an elevator car. Such a configuration might be advantageous especially in situations in which one or both of the working platforms run along the elevator car guide rails. The elevator car sling or the elevator car, or parts thereof, can be used as a working platform. By an elevator car sling, is herein meant a structure that is designed to carry the majority of the weight of an elevator car. The supporting structures in an elevator car sling are two side beams and two cross beams attachable to the roping. A working platform can be constructed on this structure. By an elevator car is herein meant the elevator car platform forming the floor of the elevator car, and the car enclosure forming the walls and the ceiling of the elevator car. If the elevator car platform and suitable railing or balustrade is mounted on the elevator car sling, this can function as the working platform. The elevator car can be constructed to its final form when the other working platform is still in use.

The second working platform is below the first working platform. This positioning allows both platforms to be constructed so that they can be used for installation work in substantially all horizontal parts of the elevator shaft. In other words, all parts of the elevator shaft are reachable from both working platforms. The two working platforms are moveable independently. This means that only one of them can move at the time or both can move simultaneously to the same or different directions. Naturally, they can both be simultaneously stationary.

As a safety system, the second working platform can comprise protective structures, such as a protective frame or a protection deck, to protect the personnel on the second working platform in case of a collision between the two working platforms or if items fall from the first working platform.

In one embodiment, the first working platform comprises a protection extension extending in a horizontal direction around the first working platform to prevent accidental falling of items from the first working platform. The protection extensions is designed to catch items that might fall from the first working platform. It is designed so that the falling items are caught early during the fall. This allows the protection extension to have light structure compared to protective structures, such as a protective frame or a protection deck, of the second working platform, above the personnel working on it. The protection extension extends in a horizontal direction to cover as large portion of the elevator shaft cross section as possible. However, at the same time, the protection extension may extend, for example, upwards. In such a case, items falling on the protection extension would tend to roll towards the first working platform contributing to the easy retrieval of the fallen items.

It is possible to construct a protection extension in a suitable position on the second working platform. In such a case, the increased velocity of the falling items needs to be taken into account, as the vertical distance between the two working platforms can be significant.

The protection extension follows approximately the contours of the elevator shaft. The space occupied by the guide rails, material hoisting systems and other items in the elevator shaft have to be taken into account when designing the shape of the protection extension.

The first and second working platform can be vertically aligned. This means that their centers would be on top of each other. To optimize the space usage in the elevator shaft, the first and second working platform can be staggered. This means that their centers are not aligned, i.e. there is an offset in their horizontal location. Such configuration could be advantageous for the ease of mounting the first and second platform hoist.

Both working platforms can have the same shape. This can be advantageous, since the working platforms can be interchangeably mounted in the transport and installation arrangement as first or second working platforms. However, depending on the elevator components to be transported and installed by the current arrangement, it might be advantageous to design the sizes of the working platforms to differ from each other. This way, the ease of transport and installation can be optimized.

The first working platform and the second working platform are meant for reaching an installation height. By an installation height is herein meant the height above the bottom of the elevator shaft at which the elevator components are installed. The first installation height is the height at which the first working platform is used for installing elevator components. The second installation height is the height at which the second working platform is used for installing elevator components. The first and second installation heights often change during the construction work. In other words, both working platforms are driven to different heights depending on the phase of the elevator installation work. It is possible that in a given working phase, the second installation height is the first installation height of a preceding working phase, or vice versa.

In one embodiment, at least one first or second installation height is at the height of at least 50 meters form the bottom of the elevators shaft; or at least one first installation height is at the height of at least 100 meters form the bottom of the elevators shaft; or at least one first installation height is at the height of at least 150 meters form the bottom of the elevators shaft; or at least one first installation height is at the height of at least 250 meters form the bottom of the elevators shaft. In an embodiment, at least one first installation height is at the height of at least 50 meters form the bottom of the elevators shaft. In an embodiment, at least one first installation height is at the height of at least 100 meters form the bottom of the elevators shaft. In an embodiment, at least one first installation height is at the height of at least 150 meters form the bottom of the elevators shaft. In an embodiment, at least one first installation height is at the height of at least 250 meters form the bottom of the elevators shaft. In an embodiment, at least one second installation height is at the height of 50 meters. By at least one installation height being at said height from the bottom of the elevator shaft is herein meant that at least one of the heights at which installation work is performed is on that height. In other words, not all of the installation heights need to be on said height, it suffices that, for example only the highest installation height is on said height.

By the bottom of the elevator shaft is herein meant the lowest position of the elevator shaft. Typically, the elevator shaft comprises an elevator pit for various elevator components. In such a case, the elevator pit floor is the bottom of the elevator shaft.

For example, the first installation height can be the height at which the elevator car or counterweight guide rail sections are installed for constructing the elevator car and counterweight guide rails, respectively. The second installation height can be the height at which the landing entrance components, for example pre-assembled landing door arrangements, are installed. In one embodiment, the first working platform is usable for installing elevator car guide rails and counterweight guide rails and the second working platform is usable for installing pre-assembled landing door arrangements. By a pre-assembled landing door arrangement is herein meant a unit comprising landing doors and their frames, including sills, left and right uprights and lintels, the top track, guide rails and door suspension equipment, as well as necessary electrical connections. In other words, a pre-assembled landing door arrangement is mounted on position and connected to the necessary couplings, after which it is essentially ready to use. A pre-assembled landing door arrangement can be installed from the elevator shaft. Alternatively, a pre-assembled landing door arrangement can be installed from the elevator landing.

Typically, the lowermost components in the elevator shaft are installed first, and the installation work progresses upwards. There can, however, be reasons to deviate from this order of installation. For example, it might be advantageous not to install the landing entrance components of those landings, which are used for storing elevator components, in the same order as the same components of other landings. In such cases, especially the second installation height can decrease as the installation work progresses.

In cases where both working platform systems are mounted above the first and second installation heights, i.e. to the top part of the elevator shaft or to a lifting beam, the route of the second platform roping needs to be guided so that it does not interfere with the movement of the first working platform. For example, sheaves or diverting pulleys can be used to guide the second platform roping. The sheaves or diverting pulleys can be mounted to, for example, the elevator shaft walls and/or to elevator car guide rails. The second platform roping can comprise more than one rope. This can be used to adjust the direction of the pulling force exerted on the second working platform. In one embodiment, the second platform roping runs through the first working platform. In such an embodiment, both platform hoists can be mounted substantially in the middle of the cross section of the elevator shaft or near it. This might be advantageous for the balancing of the working platforms. The two platform hoists can be located side-by-side at the same vertical level. Alternatively, they can be staggered, so that they are mounted at different vertical levels. Typically, the two platform ropings run side-by-side.

If the second platform roping runs through the first working platform, the first working platform needs to have a suitable opening in it. The opening needs to be protected against items accidentally falling through the opening. Additionally, as on various occasions, the first working platform may move relative to the second platform roping (i.e. when one of the working platforms is moving), the roping needs to be shielded against accidental touching of the roping by personnel working on the first working platform.

In one embodiment, the first working platform comprises a protective collar surrounding the second platform roping. The protective collar may comprise a rigid tube. The tube can be made, for example, hard plastic material, aluminum, metal net or fiber-reinforced plastic, such as glass fiber. The protective collar can alternatively be a cage. The cage can be made of metal or metal wire, for example. The protective collar may have a large enough diameter to avoid the roping touching the inside of the collar. Alternatively, the collar can have such a small diameter that the roping might at least occasionally touch the inside of the collar. A narrow collar has the advantage that it takes less space needed for working. The diameter of the protective collar can be, for example, 1-50 cm. The protective collar can be, for example, 170-300 cm in height as measured from the standing level (floor) of the first working platform. The protective collar can be 250 cm in height as measured from the standing level (floor) of the first working platform.

Both material hoisting systems comprise a material holder in addition to the material hoist and the material roping. The material holders are typically designed for transporting different materials and their structures thus also differ from each other. The structure of the first material holder and the second material holder depends on the structure of the elevator components that each of them is designed to transport.

The first material holder can be constructed to carry guide rail sections for installing elevator car guide rails and counterweight guide rails. In some embodiments, the first material holder has a bottom portion supporting the guide rail sections from below. In some embodiments, however, it is possible that the first material holder comprises one or more suspenders from which the guide rail sections hang from. The first material holder usually has a side portion for preventing the guide rail sections from swaying or otherwise moving during transport and/or for improving the balance of the first material holder. In some applications, the guide rail sections are transported within the first material holder. The first material holder typically further comprises some sort of connection means from which it is removably attachable to the material roping. It is possible that there are also dedicated fastening means for holding the guide rail sections to be transported in place. In some applications, the first material holder comprises fastening means for securing the guide rail sections in position for transport.

To achieve the benefits of the current disclosure to the largest possible extent, at least two, preferably at least four, more preferably at least six guide rail sections can be transported simultaneously by the first material holder. The number of guide rail sections to be transported can be adjusted according to the specific application. Thus, the transport and installation arrangement according to the present disclosure allows the simultaneous transport of multiple guide rail sections to the first installation height. It is possible to use the first material holder for transporting only one guide rail section. More typically, however, at least two guide rail sections are transported at the same time in the first material holder. It is also possible to calculate beforehand, how many guide rail sections are needed and to load the first material holder accordingly. It is possible to load a variable number of guide rail sections in the first material holder.

The first material holder moves along counterweight guide rails. In order to move the first material holder along the counterweight guide rails, the first material holder can comprise guiding means, such as rollers, wheels or guide shoes, for guiding its movement along the guide rail. In an embodiment, the first material holder comprises guiding means, such as rollers, wheels or guide shoes, for guiding the movement of the first material holder along the guide rail. Typically, the first material holder moves between two guide rails, and the guiding means are situated on its both sides. There can be one or more guiding means on each side of the first material holder.

The second material holder can be constructed to carry landing entrance components. The structure of the second material holder thus depends on the structure of the transportable components, which can vary. For example, if individual door leaves or landing door frame parts are transported, slings or straps can be used for attaching the transportable components to the second material holder. Also hooks, grapples and the like can be used. It is possible to construct the transportable components in a manner that facilitates their movement. Especially pre-assembled landing door arrangements can be transported with the second material hoisting system. The pre-assembled landing door arrangements can be constructed to contain, either permanently or removably, holding structures that can be designed to fit with the second material holder.

In one embodiment, the second material hoisting system is positioned laterally to the first working platform and the second working platform for moving elevator components vertically in the elevator shaft independently of the height at which the first working platform and the second working platform are. In other words, if the transport and installation arrangement according to the present disclosure is designed so that there is enough space between both working platforms and the elevator shaft wall, the second material hoisting system can be moved vertically in the elevator shaft independently of the position of the working platforms. This would allow flexibility in, for example the storage location of the transportable components: In addition to being moved from lower floors upwards, storage locations in floors above the installation heights would be possible.

In one embodiment, the second material hoisting system is suspended in front of the vertical center-line of elevator landing entrances. By the vertical center-line of elevator landing entrances is herein meant a vertical line at an equal distance from both landing entrance vertical side walls. In other words, the vertical mid-line of the landing entrance is meant. When the second material hoist is suspended in front of this line, the transportable components can be positioned in the middle of the landing entrance. This might be beneficial in embodiments, in which the components are directly installed. Such a configuration might be especially suited for pre-assembled landing door arrangements, which can be directly fitted and installed into the landing entrance.

In one embodiment, the first material hoisting system is configured to transport guide rail sections and the second material hoisting system is configured to transport pre-assembled landing door arrangements. It is also possible that the first material hoisting system is configured to transport various materials and the second material hoisting system is configured to transport pre-assembled landing door arrangements. It is also possible that the first material hoisting system is configured to transport guide rail sections and the second material hoisting system is configured to transport various materials.

In an embodiment, the first material hoisting system is configured to transport elevator components to be installed from the first working platform. In an embodiment, the second material hoisting system is configured to transport elevator components to be installed from the second working platform. In an embodiment, the first material hoisting system is configured to transport elevator components to be installed from the first working platform and the second material hoisting system is configured to transport elevator components to be installed from the second working platform.

When the transport by the first material hoisting system and the installation from the first working platform system are coupled, the transport can be optimized to take the progress of the installation work into account. The same applies for the coupling of transport by the second material hoisting system and the installation from the second working platform system.

For example, guide rail sections are transported by the first material hoisting system and the guide rail sections are installed from the first working platform. In such a case, the first material holder can be driven to the position at which the guide rail sections are loaded on the first material holder while the installation of the previously transported guide rail section is still ongoing.

At the same time, it is possible to install pre-assembled landing door arrangements from the second working platform. The transport and installation of guide rail sections and pre-assembled landing door arrangements, respectively, can be done independently of each other. In a potentially advantageous embodiment, the pre-assembled landing door arrangement is suspended from the second material hoisting system during at least a part of its installation.

Each of the working platforms can be used for additional installation work, which may coincide with the above-mentioned steps.

In some embodiments, for example in which the first and/or second working platform is used for installing heavy elevator components, such as guide rail sections or landing entrance components, the transport and installation arrangement may comprise additional material suspension safeties, which prevent the elevator components from falling in case the first and/or second material hoisting system fails.

In one embodiment, the first working platform and/or the second working platform comprise a limit switch for maintaining a predetermined minimum distance between the first working platform and the second working platform. One or both of the working platforms can be equipped with limit switches. This is to ascertain that the working platforms cannot collide. It is within the knowledge of the skilled person to construct a suitable arrangement to automatically stop the movement of both working platforms if distance between the working platforms falls below a predetermined minimum.

The current transport and installation arrangement can comprise a number of other limit switches as well. Limit switches can be used, for example, to limit the range of movement of the first material holder and/or the second material holder in both low and high end of the movement. Further, the lowest allowed position of the second working platform and the highest allowed position of the first working platform can be regulated by appropriate limit switches. The limit switches can be moveable. For example, the limit switches at the end of the guide rails can be moved as the guide rails are constructed further, and the working platform and/or the material holder are adjusted to move higher in the elevator shaft.

In another aspect, a method for parallel transport and installation of elevator components is disclosed. The method comprises simultaneously or in any order the steps of a) assembling a first working platform system;
b) assembling a first material hoisting system;
c) assembling a second working platform system; and
d) assembling a second material hoisting system.

The method is characterized in that it comprises the further step of e) transporting elevator components vertically in the elevator shaft by the first material hoisting system and the second material hoisting system and installing the elevator components.

The transport and installation method according to the present disclosure comprises installing the relevant vertically moveable systems and transporting and installing the transported elevator car components. The first working platform system, the first material hoisting system, the second working platform system and the second material hoisting system can be assembled, i.e. steps a)-d) performed, in any order. The assembly of the systems in steps a)-d) can also take place at least partially simultaneously.

At step e) elevator components are transported vertically in the elevator shaft. Although in many applications, some of the transport might be in a horizontal direction, the primary transport direction is vertical, for example between one or more landings. Step e) can be partially performed already before all of steps a)-d) are completed. If, for example, the first working platform system and the first material hoisting system are completed, they can be taken into use, i.e. step e) can be started, already while the second working platform system and the second material hoisting system are still being assembled (i.e. steps c) and d) performed). In most applications, however, step e) is performed after completing steps a)-d).

The elevator components transported by the first material hoisting system can be guide rail sections. The elevator components transported by the second material hoisting system can be pre-assembled landing door arrangements. In one embodiment, the first working platform is used for installing elevator car guide rails and counterweight guide rails and the second working platform is used for installing pre-assembled landing door arrangements.

The vertical movement in each four systems of the transport and installation arrangement according to the present disclosure is at least partially independent of other systems. Therefore, the transport and installation of step e) can be performed in any order or simultaneously. In other words, the transport by each material hoisting systems and the installation from each working platform can be conducted as is practical in each construction site. If, for example, guide rail sections are transported by the first material hoisting system and the guide rail sections are installed from the first working platform, the function of these two systems can be coordinated. Similarly if, for example, pre-assembled landing door arrangements are transported by the second material hoisting system and the pre-assembled landing door arrangements are installed from the second working platform, the function of these two systems can be coordinated.

Especially in applications where the first material hoisting system utilizes the counterweight guide rails and/or at least one of the working platforms moves along the elevator car guide rails, at least some length of counterweight guide rails and/or elevator car guide rails is installed before or during steps a)-d) are performed. In one embodiment, the method further comprises the step of installing a length of elevator car guide rails and/or a length of counterweight guide rails at any point before step e). The installation of guide rail sections can naturally continue as a part of the method according to the present disclosure.

In one embodiment, the elevator components are transported in parallel by the first material hoisting system and the second material hoisting system and/or the elevator car components are installed in parallel from the first working platform and the second working platform. In this embodiment, the function of the two hoisting systems is possible in parallel. The two working platforms can also be used in parallel. It is also possible to use all four systems in parallel. As is evident to the skilled person, in this embodiment of the method, the installation and transportation have to be organized in a safe enough manner.

In another aspect, use of the material transport and installation arrangement according to the current disclosure or the method according to the current disclosure for transporting and installing elevator components is disclosed.

DESCRIPTION OF DRAWINGS

In the figures, all parts of the transport and installation arrangement according to the present disclosure and elevator are depicted only schematically and their sizes are not drawn proportionally. Further, all elevator components not directly related to the current arrangement are omitted from the figures, although some of them might be installed before or at the same time as the current transport and installation arrangement is used. There may be various controlling and safety devices for the transport and installation arrangement according to the present disclosure, but not all of them are presented in the figures due to clarity reasons.

Figure 2:
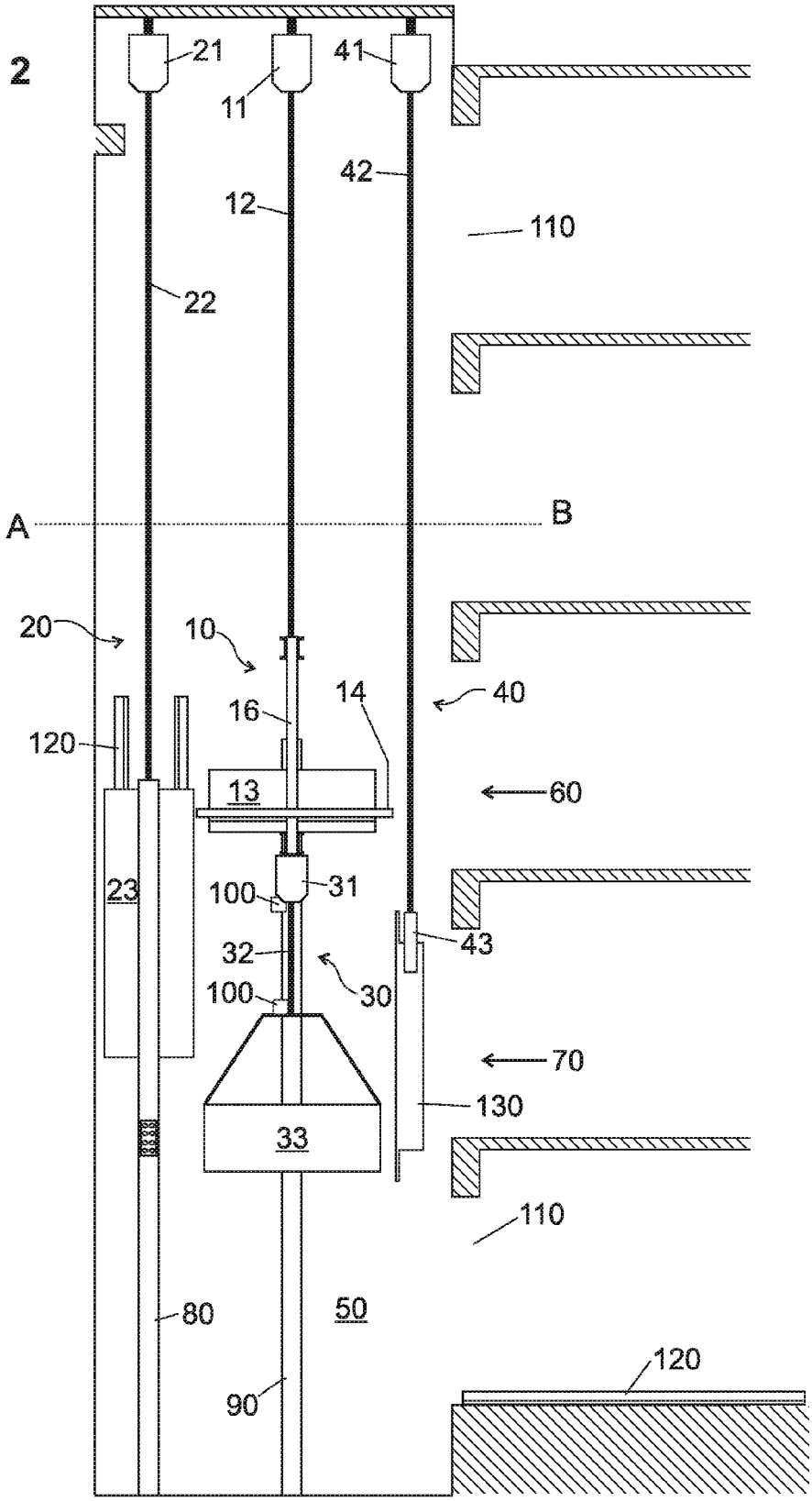
FIG. 2 presents another embodiment of the material transport and installation arrangement according to the present disclosure.

FIGS. 1 and 2 present an elevator shaft 50 comprising five landings as viewed from the side. A landing entrance 110 is indicated. In both figures, there are two counterweight guide rails 80 and two elevator car guide rails 90. The counterweight guide rail 80 further away in the viewing direction is not visible as it remains behind the counterweight guide rail 80 nearer in the viewing direction. For better presentation of the transport and installation arrangement according to the present disclosure, the elevator car guide rail 90 nearer in the viewing direction has been omitted and only the one further away in the viewing direction is partially visible behind the structures of the transport and installation arrangement.

FIG. 1 presents an embodiment of the material transport and installation arrangement according to the present disclosure in which the first working platform system 10 and the second working platform system 30 are suspended substantially at the same height. In this embodiment, all the hoists 11, 21, 31, of the transport and installation arrangement are mounted at the top part of the elevator shaft 50. More specifically, they are mounted at the elevator shaft 50 ceiling. The first platform hoist 11 and the second platform hoist 31 are close to each other near the center of the elevator shaft 50. The first platform hoist 11 and the second platform hoist 31 are staggered, so that the first platform hoist 11 is partly behind the second platform hoist 31 in this viewing direction.

In addition to the first platform hoist 11, the first working platform system 10 comprises first platform roping 12 and a first working platform 13. The first platform roping 12 extends between the first platform hoist 11 and the first working platform 13. The first platform roping 12 is attached to the center of the first working platform 13. The first working platform 13 comprises a railing or balustrade to protect the installation personnel from falling. The first working platform further comprises a frame to which the first platform roping 12 is attached.

The first working platform 13 comprises also a protection extension 14 substantially surrounding the first working platform 13. The protection extension 14 extends in a lateral direction from the first working platform 13 to the proximity of other items in the elevator shaft 50, in this case the material being transported by the second material hoisting system 40 and the material holder 23 of the first material hoisting system 20. It is possible to construct the protection extension 14 of material, or of a combination of materials, making the protection extension 14 is flexible. In such a case, there are no adverse effects even if the protection extension 14 touches some other items present in the elevator shaft 50. The protection extension 14 in the embodiment of FIG. 1 is substantially horizontal. The protection extension 14 is not symmetrical. It is wider on the side that is closer to the second material hoisting system 40.

The transport and installation arrangement of FIG. 1 further comprises a second working platform system 30, comprising a second platform hoist 31, a second platform roping 32 and a second working platform 33. The second working platform system 30 is suspended from the same height as the first working platform system 10. Since the second working platform 33 is below the first working platform 13, a route needs to be designed for the second platform roping 22. In the embodiment of FIG. 1, the second platform roping 32 runs through an opening in the first working platform 13.

The structures of the second working platform and the second platform roping 32 are similar to the first working platform 13 and the first platform roping 12, respectively. The frame to which the second platform roping 32 is attached, can have a stronger structure than the one in the first working platform 13 to lend protection for the personnel on the second working platform 33 in case the two working platforms 13, 33 collide.

Since the platform roping 12, 32 for both working platforms 13, 33 is attached to the center of each platform, the first working platform 13 and the second working platform 33 are slightly staggered, as are their respective platform hoists 11, 31.

In FIG. 1. the construction of counterweight guide rails 80 and elevator car guide rails is in progress. The first working platform 13 is at the height at which the next guide rail sections 120 are to be installed. In other words, the working platform 13 is close to the upper end of the thus far installed guide rails 80, 90. This is the first installation height 60. Guide rail sections 120 for both counterweight guide rails 80 and elevator car guide rails 90 can be installed from this position.

Also the second installation height 70 is indicated in FIG. 1. The second working platform 33 is approximately at this height. In FIG. 1, pre-assembled landing door arrangements are installed from the second working platform 33. A pre-installed landing door arrangement 130 is depicted at the second installation height 70.

Both working platforms 13, 33 are moveable along the elevator car guide rails 90. Due to the staggered orientation of the working platforms 13, 33, the elevator car guide rails 90 are not in the vertical center-line of the second working platform 33. Since the pulling force for the movement of the second working platform 33 comes from the second platform hoist 31, the unsymmetrical positioning of the second working platform 33 relative to the elevator car guide rails 90 can be used. Both working platforms 13, 33 move along the elevator car guide rails 90 by guide rollers or guide shoes (not shown). The guide rollers or guide shoes can be constructed as is known in the art.

Since in the embodiment of FIG. 1, the second platform roping 32 runs through an opening in the first working platform 13, the first working platform 13 comprises a protective collar 15. The protective collar 15 can be secured to the frame of the first working platform 13. The portion of the second platform roping 32 running in the protective collar 15 is dashed in FIG. 1.

To ascertain that the first working platform 13 and the second working platform 33 do not collide, each of the working platforms 13, 33 comprises a limit switch 100. In the first working platform 13, the limit switch 100 is positioned below the working platform 13. In the second working platform 33, the limit switch 100 is positioned at the top of the working platform 33. Depending on the working principle of the limit switches 100, only one of the working platforms 13, 33 can be equipped with a limit switch 100. The minimum allowed distance between the two working platforms 13, 33, as well as required couplings between limit switches 100 and the driving systems of the working platforms 12, 33, can be determined by the skilled person. The transport and installation arrangement can comprise further limit switches 100 for controlling the range of movement of the different systems.

The transport and installation arrangement of FIG. 1 further comprises a first material hoisting system 20. The material hoisting system comprises a first material hoist 21, a first material roping 22 and a first material holder 23.

The first material hoist 21 and the first material roping 22 are constructed essentially as the corresponding structures in the first and second working platform systems 10, 30. The first material holder 23 moves along the counterweight guide rails 80, of which there are two, although only one is visible in the viewing direction of FIGS. 1 and 2. The material holder 23 is partially behind the frontmost counterweight guide rail 80 as it is located between the two guide rails 80. The material holder 23 according to this embodiment is a basket-like structure where the guide rail sections 120 stand upright in two rows. The material holder 23 has a bottom portion on which the guide rail sections 120 rest and a side portion holding the guide rail sections 120 upright. There might be additional fastening or support structures in the material holder 23 to allow the safe and stable transport of the guide rail sections 120. The material holder 23 has guide rollers or guide shoes 140 at its sides to mediate the contact with the guide rails 80 (not visible in FIG. 1). The material holder 23 also has attachment means, for example a loop or a lifting eye, from which it is removably attachable to the first material roping 22 (none of the attachment means is depicted in the figures for simplicity).

Also a second material hoisting system 40 is depicted in FIG. 1. The second material hoisting system 40 comprises a second material hoist 41 and second material roping 42, both of which have a similar structure to the systems described above. The second material hoisting system 40 further comprises a second material holder 43. In the embodiment of FIG. 1, the second material holder 43 is shaped as a suspender from which the elevator components are suspended. In this embodiment, the elevator component transported by the second material hoisting system 40 are pre-assembled landing door arrangements 130.

The location from which the elevator components or possible other transportable material is loaded on the first and second material hoisting systems 20, 40 is indicated in FIG. 1 by a guide rail section 120 present at the lowermost landing. In addition to guide rail sections 120, any other transportable material could be stored at this location. Especially in the case for higher elevator shafts, typically comprising more landings, it might be advantageous to load the transportable elevator components from more than one landing. In other words, also landings higher up in the elevator shaft 50 can be used for storing transportable elevator components.

FIG. 2 presents another embodiment of the material transport and installation arrangement according to the present disclosure. Also this embodiment comprises a first working platform system 10, a first material hoisting system 20, a second working platform system 30 and a second material hoisting system 40. The landing entrances 110 and the material storage with a guide rail section 120 at the lowest landing are depicted. The first working platform 13 is at the first installation height 60 and the second working platform 33 at the second installation height 70. In this embodiment, the first working platform 13 comprises an elevator car sling 16. The elevator car sling 16 comprises two vertical side beams, the frontmost of which is depicted, and four horizontal beams. The ends of the horizontal beams are visible in the top and bottom of the elevator car sling 16. The floor of the first working platform 13 can be either the same that will eventually be used in the elevator car. Alternatively, the floor of the first working platform can be temporary. In the latter case, the elevator car sling will be later equipped with the floor that will serve the elevator car.

The first and second material hoisting systems 20, 40 of FIG. 2 comprise material hoists 21, 41 and material ropings 22, 42, as well as material holders 23, 43. All the components are essentially as described for the embodiment in FIG. 1. The second material hoisting system 40, however can be suspended further away from the elevator shaft 50 wall, since the first working platform 13 and the second working platform 33 are vertically aligned in this embodiment. This is also reflected in the shape of the protection extension 14 of the first working platform 13, which in this embodiment is symmetrical. Also in this embodiment, guide rail sections 120 are transported by the first material hoisting system 20 and pre-assembled landing door arrangements by the second material hoisting system 40.

A difference between the embodiments in FIGS. 1 and 2 is that in the embodiment of FIG. 2, the second working platform system 30 is mounted on the first working platform 13. In other words, the second platform hoist 31 is attached or suspended from the first working platform 13. In this case, the second platform hoist 31 is suspended from the elevator car sling 16 components, such as the side beam and/or the horizontal beam(s). The rest of the components of the second working platform system 30 are similar to that of FIG. 1.

In this embodiment, it is possible to have the two working platforms 13, 33 aligned in the vertical direction. The vertical alignment of the two working platforms 13, 33 might be advantageous for balancing of the both working platform systems 10, 30 and for the lateral space available for other components of the transport and installation arrangement in the elevator shaft 50. The elevator car guide rails 90 are in the vertical center-line of the second working platform 33. In other words, the center of balance of the second working platform 33 lies between the elevator car guide rails 90.

Also the components of the first working platform system 10 are similar to that of FIG. 1. The first platform hoist 11 is mounted at the top part of the elevator shaft 50 and the first platform roping 12 extends vertically between the hoist 11 and the working platform 13. However, since also the second working platform 33 is supported by the first platform hoist 11 and the first platform roping 12, the increased load is taken into account in their design. The components as well as their attachments might be more robust than in embodiments where only the first working platform 13 would be suspended from the first platform hoist 11 and the first platform roping 12. The same effect can be taken into account when designing the first working platform 13 and especially its supporting structures.

Since in the embodiment of FIG. 2, the second platform roping 32 does not run through the first working platform 13, there is no need for and opening in the first working platform 13. However, if the platforms are used for both embodiments in which the opening is present and in which it is absent, the working platforms 13, 33 can be equipped with a sealable opening. In other words, the platforms used as the first working platform 13 and as the second working platform 33 can be identical in structure and the opening taken into use only if necessary. Also the protective collar 15 (FIG. 1) can be releasably attachable to the working platform 13 structure.

Further, as the second platform hoist 31 can be the lowermost structure moving together with the first working platform 13, a limit switch 100 might be mounted on it, instead the first working platform 13 structure. As for the embodiment of FIG. 1, also here it is possible to have only one limit switch 100 controlling the distance of the working platforms 13, 33.

Figure 3:
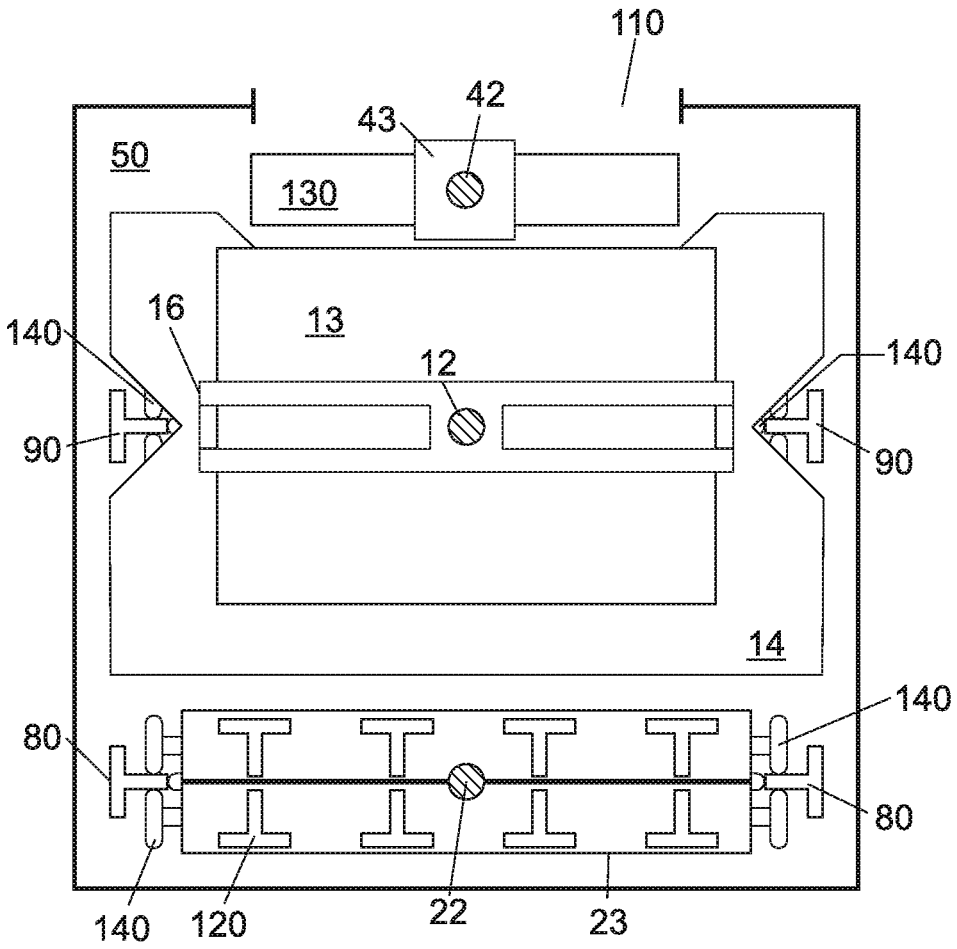
FIG. 3 presents an embodiment of the material transport and installation arrangement of FIG. 2 viewed from above.

FIG. 3 presents an embodiment of the material transport and installation arrangement of FIG. 2 viewed from above. The viewing height is indicated in FIG. 2 by the dashed line A-B.

The walls of elevator shaft 50 enclose the transport and installation arrangement, and a landing entrance 110 is visible at the top of the figure. The first working platform 13 and a cross section of the first platform roping 12 are shown in the middle of the figure. The second working platform 33 is directly below the first working platform 13 and it is thus not visible in this viewing direction. The first working platform comprises an elevator car sling 16 and the ends of the vertical beams are visible on both sides of the first working platform 13. The two horizontal beams are visible. The first platform roping 12 is connected to the horizontal beams, but all details of the connection are omitted, as they are known to the skilled person.

From this viewing direction, the shape of the protection extension 14 can be seen. The protection extension 14 approximately follows the contours of the components in the elevator shaft 50. An indentation in the protection extension 14 is made to accommodate the shape of the elevator car guide rails 90. In this case, the pre-assembled landing door arrangement 130 comes so close to the first working platform 13 that the protection extension 14 has been omitted from the side closest to the second material hoisting system 40.

The first material holder 23 and the cross section of the first material roping 22 are shown. The guide rail sections 120 transported in the first material holder 23 can be seen. In this embodiment, eight guide rail section 120 are transported simultaneously. Further, the second material holder 43 and the cross section of the second material roping 42 are depicted. A pre-assembled landing door arrangement 130 is being transported by the second material holder 43.

The first working platform 13 moves along the elevator car guide rails 90 and the first material holder 23 moves along the counterweight guide rails 80. The positioning of the first working platform 13 and the first material holder 23 between the guide rails 90, 80 can be seen. The guide rollers 140 mediating the contact between the first working platform 13 and the elevator car guide rails 90, and the first material holder 23 and the counterweight guide rails 80, respectively, are visible. There are three guide rollers 140 making contact with each guide rail 80, 90. It is possible, that there would be further guide rollers 140 below or above the ones shown in FIG. 3 making contact with the guide rails 80, 90, but they are not depicted.

The above embodiments are to be understood as illustrative examples. Further embodiments are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A transport and installation arrangement for parallel transport and installation of elevator components, comprising:

a first working platform system in an elevator shaft configured to reach a first installation height, the first working platform system including a first platform hoist, a first platform roping and a vertically movable first working platform, the vertically movable first working platform configured to support first personnel working on the installation of the elevator components at a first height in the elevator shaft;

a first material hoisting system configured to transport the elevator components vertically in the elevator shaft to the first personnel on the vertically movable first working platform, the first material hoisting system including a first material hoist, a first material roping and a first material holder, the first material holder being movable along at least one counterweight guide rail;

a second working platform system in the elevator shaft configured to reach a second installation height, the second working platform system including a second platform hoist, a second platform roping and a vertically movable second working platform, the vertically movable second working platform configured to support second personnel working on the installation of the elevator components at a second height in the elevator shaft, the second working platform being below the first working platform; and a second material hoisting system configured to transport the elevator components vertically in the elevator shaft to the second personnel on the vertically movable second working platform, the second material hoisting system including a second material hoist, a second material roping and a second material holder, the second material hoist being a separate hoist attached to a top of the elevator shaft on an opposite side of the elevator shaft from the first material hoist attached to the top of the elevator shaft such that elevator components are transportable to the first personnel on the first working platform and the second personnel on the second working platform in parallel by the first material hoisting system and the second material hoisting system, respectively.

2. The transport and installation arrangement according to claim 1, wherein at least a first one of the first working platform system and the second working platform system is mounted to the top of the elevator shaft, and a second one of the first working platform system and the second working platform system is mounted to one of (i) the top of the elevator shaft and (ii) the first one of the first working platform system and the second working platform system.

3. The transport and installation arrangement according to claim 1, wherein the second platform roping runs through the first working platform.

4. The transport and installation arrangement according to claim 3, wherein the first working platform comprises a protective collar surrounding the second platform roping.

5. The transport and installation arrangement according to claim 1, wherein the first working platform system is connected to at least one of a top part of the elevator shaft, and one or more lifting beams installed above the first and second installation heights; and the second working platform system is on the first working platform.

6. The transport and installation arrangement according to claim 1, wherein at least one of the first working platform system and the second working platform system is movable along elevator car guide rails.

7. The transport and installation arrangement according to claim 1, wherein the second material hoisting system is positioned laterally to the first working platform and the second working platform such that the elevator components move vertically in the elevator shaft independently of the height at which the first working platform and the second working platform are located.

8. The transport and installation arrangement according to claim 1, wherein the second material hoisting system is suspended in front of a vertical center-line of elevator landing entrances.

9. The transport and installation arrangement according to claim 1, wherein the first material hoisting system is configured to transport guide rail sections and the second material hoisting system is configured to transport pre-assembled landing door arrangements.

10. The transport and installation arrangement according to claim 1, wherein the first working platform comprises a protection extension extending in a horizontal direction around the first working platform to prevent accidental falling of items from the first working platform.

11. The transport and installation arrangement according to claim 1, wherein at least one of the first working platform and the second working platform includes a limit switch to maintain a set minimum distance between the first working platform and the second working platform.

12. The transport and installation arrangement according to claim 1, wherein at least one of the first working platform and the second working platform comprises an elevator car.

13. The transport and installation arrangement according to claim 1, wherein the first working platform is used to install elevator car guide rails and counterweight guide rails while building an elevator in the elevator shaft, and the second working platform is used to install pre-assembled landing door arrangements while building an elevator in the elevator shaft.

14. The transport and installation arrangement according to claim 1, wherein at least one of the first and the second installation height is at a height of at least 50 meters form a bottom of the elevators shaft.

* * * * *